US005969477A

United States Patent [19]

Haraguchi et al.

[11] Patent Number: 5,969,477

[45] Date of Patent: Oct. 19, 1999

[54] CATHODE-RAY TUBE APPARATUS WITH A COMMON DEFLECTION DRIVING CIRCUIT

[75] Inventors: Yuuji Haraguchi; Takashi Nishimura, both of Fukaya, Japan

[73] Assignee: Kabushiki Kaisha Toshiba, Kawasaki, Japan

[21] Appl. No.: 08/908,800

[22] Filed: Aug. 8, 1997

[30] Foreign Application Priority Data

Aug. 8, 1996 [JP] Japan ..... 8-209442

[51] Int. Cl.[6] ..... H01J 29/98; G09G 1/20; G09G 1/04

[52] U.S. Cl. ..... 315/9; 313/2.1; 313/422; 313/427; 315/13.1

[58] Field of Search ..... 315/9, 13.1, 374; 313/2.1, 427, 426, 422; 348/778

[56] References Cited

U.S. PATENT DOCUMENTS

| | | | |
|---|---|---|---|
| 4,777,407 | 10/1988 | Takenaka et al. | 315/9 |
| 5,498,921 | 3/1996 | Nishimura et al. . | |
| 5,831,373 | 11/1998 | Takahashi et al. | 313/2.1 |

FOREIGN PATENT DOCUMENTS

| | | |
|---|---|---|
| 226423 | 6/1987 | European Pat. Off. . |
| 387911 | 9/1990 | European Pat. Off. . |
| 725421 | 8/1996 | European Pat. Off. . |
| 93/21651 | 10/1993 | WIPO . |

OTHER PUBLICATIONS

Shizuo: "Flat CRT Designs Pose Technological Challenges, Pave Paths to New Uses", JEE Jour. of Electronic Engineering, vol. 31, Feb. 1994, pp. 106–111.

*Primary Examiner*—Edward P. Westin
*Assistant Examiner*—Shane R. Gardner
*Attorney, Agent, or Firm*—Pillsbury Madison & Sutro LLP

[57] ABSTRACT

On a rear plate of a vacuum envelope are provided a plurality of electron guns for emitting electron beams to a phosphor screen, and deflection devices for deflecting the plurality of electron beams emitted from the respective electron guns so as to dividedly scan a plurality of regions of the phosphor screen by the electron beams. Each of the deflection devices has a horizontal deflection coil and a vertical deflection coil. The horizontal deflection coils of the deflection devices are connected to one another in series, and the vertical deflection coils of the deflection devices are connected to one another in series. All the deflection devices are driven by a common deflection driving circuit which has a horizontal deflection driving circuit connected to the horizontal deflection coils and a vertical deflection driving circuit connected to the vertical deflection coils.

9 Claims, 7 Drawing Sheets

CATHODE-RAY TUBE APPARATUS WITH A COMMON DEFLECTION DRIVING CIRCUIT

BACKGROUND OF THE INVENTION

1. Field of Invention

The present invention relates to a cathode-ray tube apparatus such as a color-picture tube apparatus and, more particularly, to a cathode-ray tube apparatus wherein electron beams emitted from a plurality of electron guns are deflected by a plurality of deflection devices and the phosphor screen has a plurality of regions which are dividedly scanned.

2. Description of Related Art

Recently, a high resolution cathode-ray tube has been more and more demanded for high-definition TV broadcasting and large screen display accompanied therewith. Particularly, to display such high definition pictures, a much higher performance has been demanded in the display screen. To achieve these demands, flatness of the screen, high resolution of pictures and reduction of aberration in deflection are absolutely necessary. At the same time, the weight and thickness of the cathode-ray tube must be reduced.

In the prior art, for example, Jpn. Pat. Appln. KOKAI Publication No. 5-36363 has disclosed a cathode-ray tube apparatus which satisfies such demands. According to this proposal, an integrated phosphor screen without discontinuity is formed on an inner surface of a flat, rectangular face plate. An electron gun is disposed within a neck of each of a plurality of funnels provided on a rear plate opposing the face plate. Electron beams emitted from such a plurality of the electron guns are deflected by a plurality of deflection devices disposed corresponding to the respective electron guns. The phosphor screen has a plurality of regions which are dividedly scanned by the electron guns. Then divided images obtained by such divisional scanning are joined together to produce a synthesized image and the synthesized image is displayed on the phosphor screen.

In the cathode-ray tube apparatus, the plurality of the deflection devices disposed corresponding to the respective electron guns are driven by a plurality of independent deflection driving circuits like an ordinary cathode-ray tube apparatus in which a single phosphor screen is entirely scanned with electron beams emitted from a single electron gun so as to produce a single image on the phosphor screen.

Further in such a cathode-ray tube apparatus, divided images displayed in adjacent regions must be smoothly continuous with each other visually without any sense of incongruity across borders between the regions scanned independently of one another. For this purpose, in the cathode-ray tube apparatus, a plurality of the deflection devices disposed corresponding to the plurality of the electron guns are adjusted in position so that they are located at optimum positions. Further, the deflection driving circuits corresponding to the respective deflection devices are adjusted into optimum condition. Through these adjustments, it is intended so that the division pictures displayed in respective regions are smoothly continuous with each other visually without sense of incongruity between the division pictures displayed in the adjacent regions.

U.S. Pat. No. 5,498,921 discloses a method for adjusting the position of deflection devices. According to this method, preliminarily, a plurality of deflection devices are fixed at reference positions on a reference fixing board and the relative positions thereof are adjusted to a predetermined position. After that, the deflection devices are mounted to funnels in a cathode-ray tube together with the reference fixing board. Then, the position of the reference fixing board is adjusted relative to the funnels. Accordingly, the mounting positions of the plurality of the deflection devices are adjusted at the same time.

Further, Jpn. Pat. Appln. KOKAI Publication No. 8-241,684 discloses a method for making orbits of electron beams emitted from a plurality of electron guns coincide with reference axes in respective regions to be scanned independently of one another.

However, a plurality of the deflection driving circuits disposed corresponding to the plurality of the deflection devices must be adjusted individually because the scanning range with electron beam differs depending on the deflection device and the linearity of each region differs from the central portion to the peripheral portion thereof. Further, discontinuity between adjacent regions must be eliminated so as to produce a continuous image without discontinuity.

As a result, in the cathode-ray tube apparatus having such a construction, if the number of the regions of the phosphor screen increases, the number of the deflection driving circuits also increases, so that time needed for adjustment of those components increases. To obtain a synthesized image visually without any sense of congruity by synthesizing divided images displayed in the respective regions, such adjustments are necessary, first, that the linearity in the central portion and peripheral portion of each divided image is smoothly continuous other visually without sense of incongruity, and second, so that the divided images are continuous with each other at the boundaries between adjacent regions.

However, in the adjustment of the deflection driving circuit, first, one of those adjustments, for example, adjustment of linearity in respective regions is carried out and then adjustment for ensuring continuity between adjacent regions is carried out. In this case, when the latter adjustment is performed, the initially adjusted linearity is deviated. Thus, these two kinds of adjustments must be performed repeatedly. Additionally, these adjustments are very difficult to do and take long time.

BRIEF SUMMARY OF THE INVENTION

The present invention has been contrived in consideration of the above circumstances, and its object is to provide a cathode-ray tube apparatus wherein a plurality of deflection devices are arranged so as to obtain the same linearity thereby facilitating the adjustment for obtaining a single synthesized image visually without any sense of incongruity from divided images displayed in a plurality of regions.

In order to achieve the above object, according to the present invention, there is provided a cathode-ray tube apparatus comprising: a vacuum envelope having a substantially rectangular flat face plate and a substantially rectangular flat rear plate disposed to oppose the face plate substantially in parallel thereto; a phosphor screen formed on an inner surface of the face plate; a plurality of electron guns disposed on the rear plate, for emitting electron beams toward the phosphor screen; and deflecting means for deflecting a plurality of electron beams emitted from the electron guns so as to dividedly scan a plurality of regions of the phosphor screen by the electron beams. The deflecting means includes a plurality of deflection devices disposed corresponding to the respective electron guns and each having horizontal and vertical deflection coils for deflecting the electron beam emitted from the corresponding electron gun; and a common deflection driving circuit for driving at least two of the deflection devices.

In the cathode-ray tube apparatus having the above described construction, the adjustment for linearity of two or more deflection devices connected to the common deflection driving circuit can be performed simultaneously by adjusting the common deflection driving circuit, thereby facilitating the adjustment for obtaining an optimum image.

In the cathode-ray tube apparatus according to the present invention, the deflecting means include a plurality of correcting elements connected to the respective deflection devices which are driven by the common deflection driving circuit, for correcting the amplitude of deflection current flowing in horizontal and vertical deflection coils in the deflection devices.

Consequently, the amplitude of deflection current flowing in the deflection coils of the respective deflection devices is corrected to a predetermined value by the correcting elements so that a difference in performance among a plurality of the deflection devices can be absorbed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 5 show a cathode-ray tube apparatus according to a first embodiment of the present invention, in which:

FIG. 1 is a perspective view of the cathode-ray tube apparatus,

FIG. 2 is a side view of the cathode-ray tube apparatus showing a partly broken part along the line II—II in FIG. 1, FIG. 3 is an exploded perspective view showing the entire cathode-ray tube apparatus, FIG. 4 is a side view of a deflection device, and FIG. 5 is a diagram showing schematically a connection of the deflection devices and deflection driving circuits;

DETAILED DESCRIPTION OF THE INVENTION

A color cathode-ray tube apparatus according to an embodiment of the present invention will be described in detail with reference to the accompanying drawings.

Figure 1:
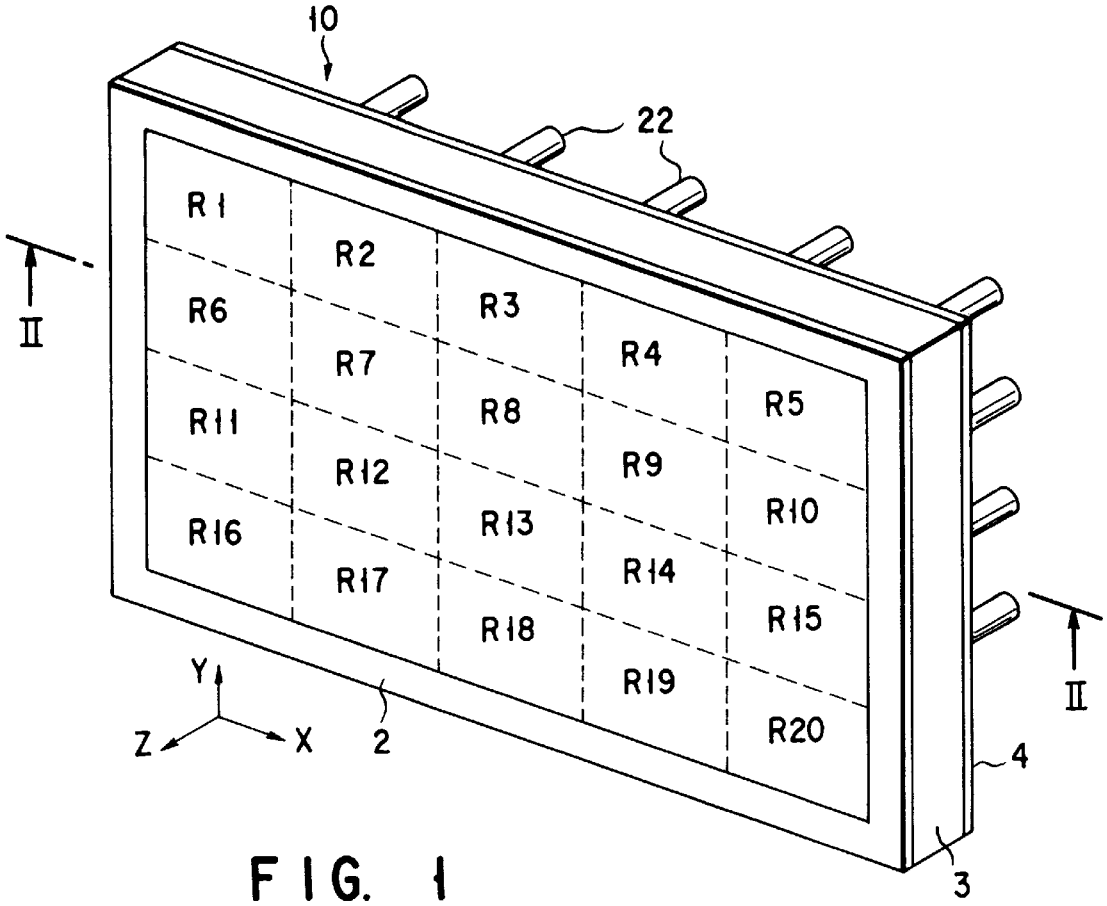
Figure 2:
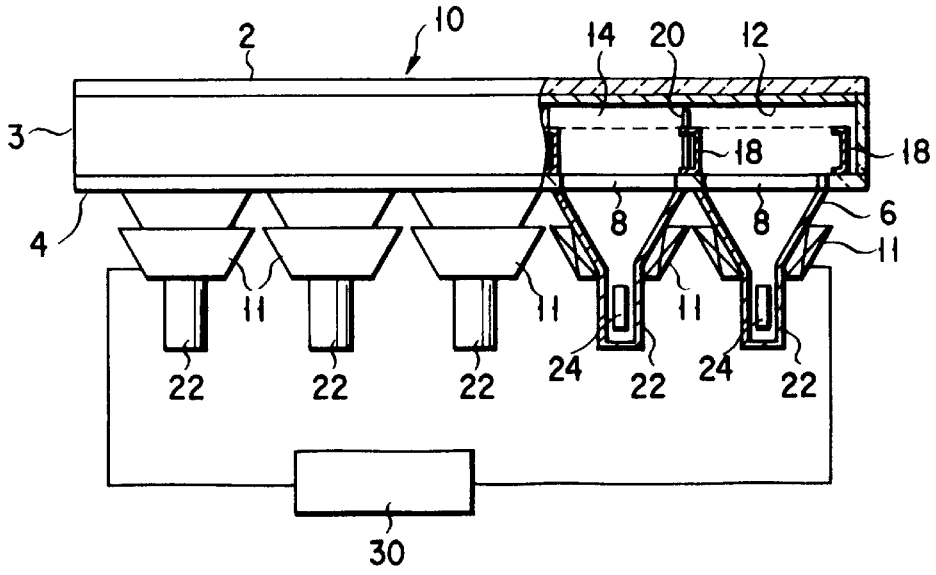
Figure 3:
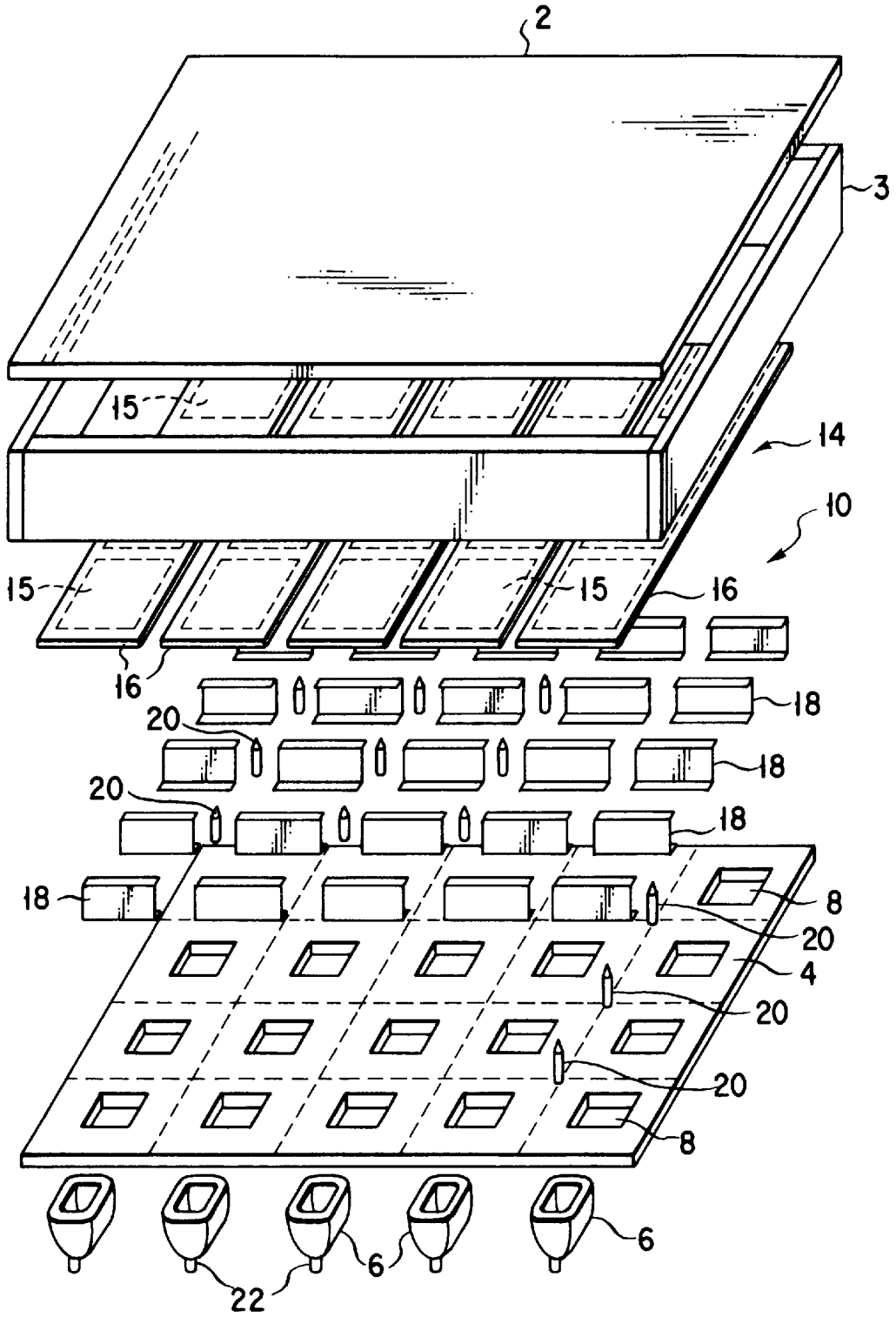

As shown in FIGS. 1 and 2, the cathode-ray tube apparatus has a vacuum envelope 10, which comprises a substantially rectangular, flat, face plate 2, frame-like side walls 3 which are joined to the edge portion of the face plate 2 and extend in a direction substantially perpendicular to the face plate 2, a substantially rectangular, flat, rear plate 4 which is joined to the side wall 3 and disposed to oppose the face plate 2 in parallel thereto, and a plurality of funnels 6 joined to the rear plate 4.

The rear plate 4 is provided with a plurality of (e.g., 20) rectangular openings 8, which are arranged in the form of a matrix, e.g., five (columns)× four (rows). A plurality of funnels 6 are joined to the outer surface of the rear plate 4 so as to surround the corresponding openings 8. A total of 20 funnels are arranged in the form of a matrix of five funnels in the horizontal direction (X-direction)× four funnels in the vertical direction (Y-direction).

On the inner surface of the face plate 2 is formed an integrated phosphor screen 12. The integrated phosphor screen 12 has stripe-shaped three-color phosphor layers R, G, B and black stripes (light shielding layer) provided between the three-color phosphor layers. Additionally, a metal-back layer is formed on the phosphor screen 12.

A flat shadow mask 14 is arranged in the vacuum envelope 10 to oppose the phosphor screen 12. The shadow mask 14 has a plurality of effective portions 15 corresponding to a plurality of regions R1 to R20 of the phosphor screen 12 which are scanned dividedly of one another, as will be described later. A large number of electron beam passage apertures are formed in each effective portion.

The shadow mask 14 is divided into five division masks 16 in the horizontal direction in correspondence with the number of divided regions of the phosphor screen 12 in the horizontal direction. Each division mask 16 is supported on the rear plate 4 by a plurality of mask support members 18. A plurality of plate support members 20 made of metallic columnar members are arranged between the face plate 2 and the rear plate 4 to support the load of the atmospheric pressure acting on the face plate and the rear plate.

An electron gun 24 for emitting electron beam to the phosphor screen 12 is disposed in each of necks 22 provided on a plurality of the funnels 6. Further, a deflection device 11 is mounted around each neck 22. A total of 20 deflection devices (11-1 to 11-20) are provided.

In the color cathode-ray tube apparatus, an electron beam emitted from each electron gun 24 is deflected horizontally and vertically by using a magnetic field generated by the deflection device 11. With the operation, a plurality of regions Rl to R20 (five regions in each row; four regions in each column; a total of 20) of the phosphor screen 12 is dividedly scanned by the electron beams via the shadow masks 14. Rasters formed on the phosphor screen 12 by the divisional scan are connected with each other by controlling signals applied to the electron guns 24 and the deflection devices 11. As a result, a single large raster free from discontinuity and overlap is reproduced on the entire phosphor screen 12.

Figure 4:
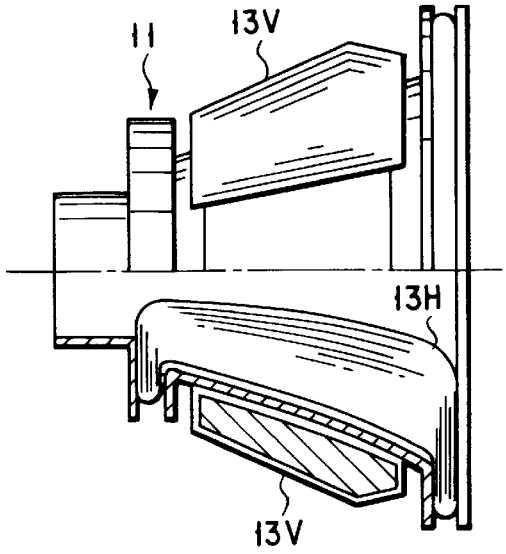

As shown in FIG. 4, each deflection device 11 includes a horizontal deflection coil 13H for generating a magnetic field for deflecting electron beam emitted from the electron gun 24 horizontally, and a vertical deflection coil 13V for generating a magnetic field for deflecting the electron beam vertically.

Figure 5:
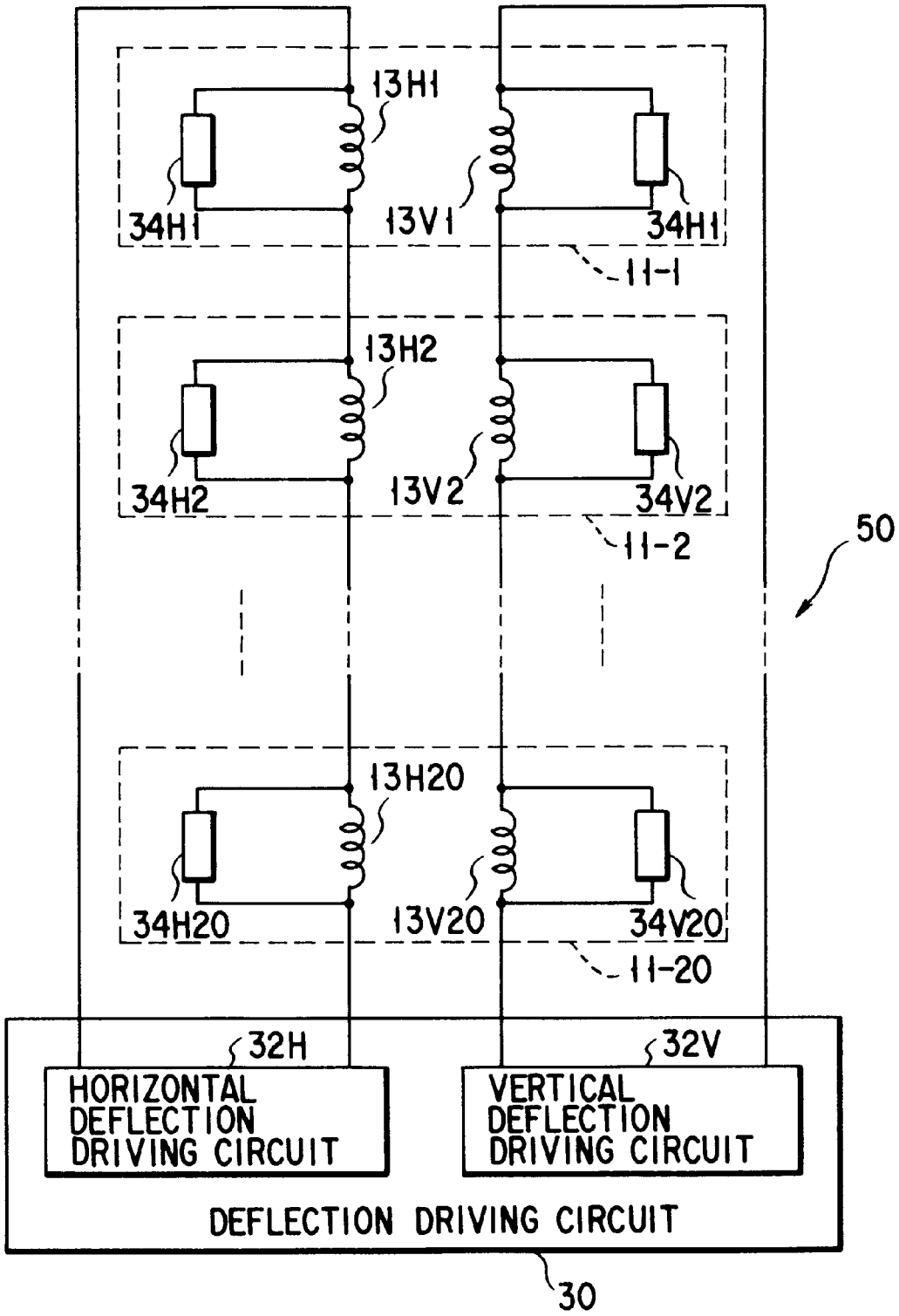

As shown in FIG. 5, the 20 deflection devices, 11-1 to 11-20 (only 11-1, 11-2 and 11-20 are indicated here) are connected to a single deflection driving circuit 30 in series and driven by the deflection driving circuit 30. The deflection driving circuit 30 comprises a horizontal deflection driving circuit 32H for supplying horizontal deflection current, and a vertical deflection driving circuit 32*v* for supplying vertical deflection current. The horizontal deflection coils 13H1-13H20 (only 13H1, 13H2 and 13H20 are indicated here) of the 20 deflection devices 11-1 to 11-20 are connected to the horizontal deflection driving circuit 32H in series. And 20 vertical deflection coils 13V1 to 13V20 (only 13V1, 13V2 and 13V20 are indicated) are connected to the vertical deflection driving circuit 32V in series. Each of the horizontal and vertical deflection driving circuits 32H and 32V includes an amplitude, position and image distortion adjusting circuits.

Horizontal deflection correcting elements 34H1 to 34H20 (only 34H1, 34H2 and 34H20 are indicated here) for correcting the amplitude of horizontal deflection current flowing through the horizontal deflection coils 13H1 to 13H20 are connected to the respective horizontal deflection coils 13H1 to 13H20 in parallel. Vertical deflection correcting elements 34V1 to 34V20 (only 34V1, 34V2 and 34V20 are indicated here) for correcting the amplitude of vertical deflection current flowing through the vertical deflection coils 13V1 to 13V20 are connected to the respective vertical deflection coils 13V1 to 13V20 in parallel.

Each of the horizontal deflection correcting element 34H1 to 34H20 comprises a variable inductance element (variable coil). Its variable inductance differs depending on the basic specification of the horizontal deflection coils 13H1 to 13H20 and the specification of the color cathode-ray tube apparatus. In this embodiment, when each region is scanned with an electron beam in such a condition in which the respective horizontal deflection correcting elements 34H1 to 34H20 are not connected to the respective horizontal deflection coils 13H to 13H20, a differential of scanning range in the respective regions is 5% or below. Thus the horizontal deflection correcting elements 34H1 to 34H20 are set so that the inductance is variable in a range of 1 to 7 mH so as to correct the amplitude in the range of the differential.

Because a differential of scanning range in the respective regions by the vertical deflection coils 13V1–13V20 is 3% or below when the vertical deflection correcting elements 32V1–32V20 are not provided, a variable resistor capable of changing its resistance in a range of 2–50 Ω is utilized as each of the vertical deflection correcting elements 34V1–34V20.

As described above, the horizontal deflection coils 13H1–13H20 are connected to the horizontal deflection driving circuit 32H in series and the vertical deflection coils 13V1–13V20 are connected to the vertical deflection driving circuit 32V in series. Further, the horizontal deflection correcting elements 34H1–34H20 each made of the variable inductance element are connected to the respective horizontal deflection coils 13H1–13H20 in parallel. The vertical deflection correcting elements 34V1–34V20 each made of the variable resistor are connected to the respective vertical deflection coils 13V1–13V20 in parallel. The horizontal and vertical deflection correcting elements eliminate a difference in performance among the deflection devices 11-1 to 11-20. By adjusting the amplitude, location and distortion in the single horizontal deflection driving circuit 32H and the single vertical deflection driving circuit 32V, the linearity in all the regions R1–R20 can be adjusted regardless of continuity between respective adjacent regions. As a result, an optimum synthesized image can be obtained easily.

Figure 6:
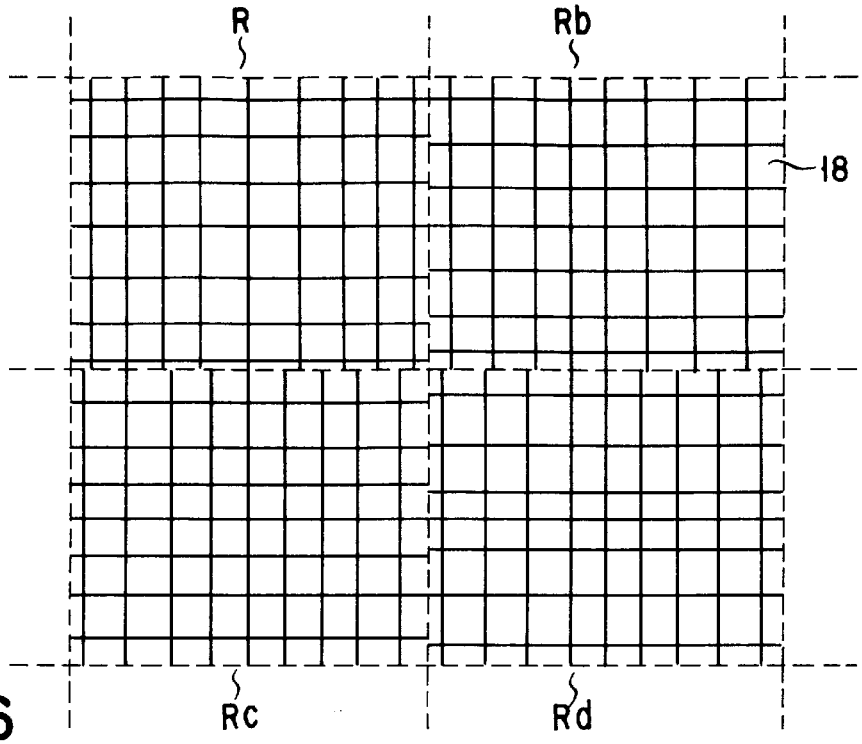
FIG. 6 is a plan view showing four adjacent regions on a phosphor screen, each displaying cross hatch pattern, in a cathode-ray tube apparatus wherein a plurality of deflection devices are driven by a plurality of deflection driving circuits, respectively, as a comparative example.

For a comparative example, FIG. 6 shows adjacent arbitrary four regions Ra–Rd in an ordinary cathode-ray tube apparatus in which a plurality of deflection devices are driven by independent deflection driving circuits, prior to adjustment of the respective deflection driving circuits. In the respective regions, cross hatch patterns 40 are drawn. The linearities of the patterns 40 displayed in these regions Ra–Rd are random so that they are not connected to each other across each boundary between the adjacent regions. The size of scanning range differs among the regions. However, because the respective scanning regions are limited on the phosphor screen, any further scanning regions are not indicated here.

In order to equalize the linearities of images displayed in the respective regions and join together the images of the adjacent regions in such a cathode-ray tube apparatus, first the amplitude, location and distortion in the horizontal and vertical directions must be optimized independently by means of deflection driving circuits provided independently of respective deflection devices. Second, it is necessary to adjust the linearity in each of the scanning regions and then so adjust to join the images of the adjacent regions so that they are continuous with each other.

On the other hand, in the cathode-ray tube apparatus according to the instant embodiment, the deflection devices 11-1 to 11-20 are connected to the common horizontal and vertical deflection driving circuits 32H, 32V. Thus, the waveform of current flowing to the respective horizontal deflection coils 13H1–13H20 in the deflection devices are basically the same and the waveform of current flowing to the respective vertical deflection coils 13V1–13V20 are also basically the same. Thus, even if there occurs a difference in scanning range due to a difference in electric characteristics which is caused mainly by an error in production of the deflection devices 11-1 to 11-20, a required adjustment is only to adjust the individual deflection coil so as to eliminate the difference in the scanning range to make it uniform.

Figure 7:
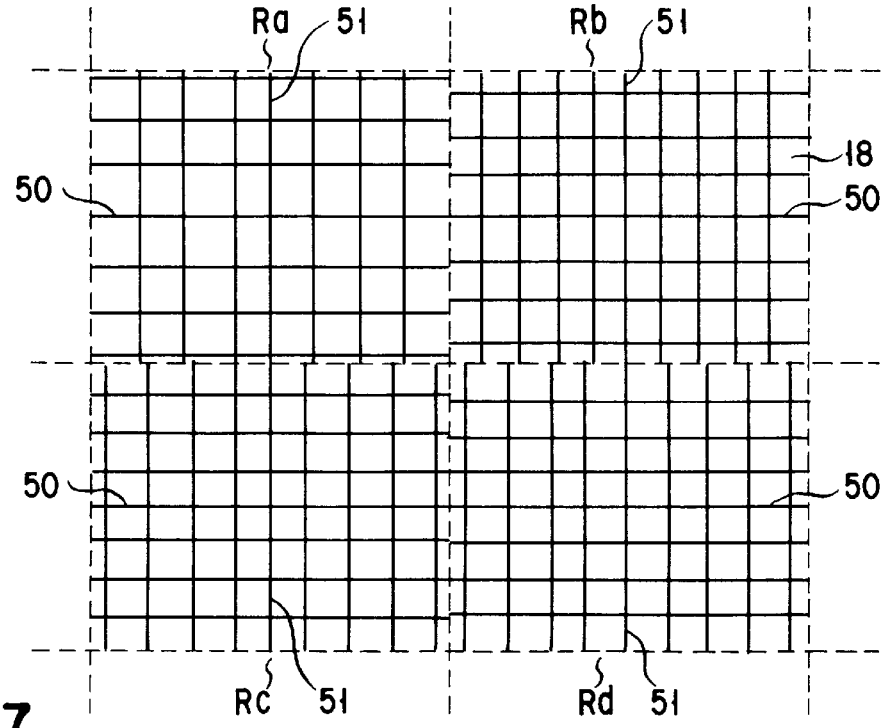
FIG. 7 is a plan view showing four adjacent regions on the phosphor screen, each displaying cross hatch pattern, in the cathode-ray tube according to the embodiment.

FIG. 7 shows adjacent arbitrary four regions Ra–Rd in the cathode-ray tube apparatus according to the instant embodiment, prior to adjustment of the deflection driving circuit 30. Each region displays a cross hatch pattern 40. Although the patterns 40 of the respective regions Ra–Rd are deviated from each other at each boundary, the patterns 40 thereof coincide with each other on horizontal and vertical axes 50, 51 which extend through centers of the respective regions Ra–Rd and thus a deflection in the linearity of the respective regions coincides with each other. Therefore it is found that a deviation in images results from only an error in the deflection coils corresponding to the regions, that is, a difference in the size of the scanning ranges. Thus it is possible to make the images in the adjacent regions Ra–Rd to continue with each other, by adjusting the scanning ranges by means of the horizontal and vertical deflection correcting elements connected to the horizontal and vertical deflection coils of the deflection devices 11 corresponding to the regions Ra–Rd.

In this case, there sometimes occurs a case in which the linearities are not continuous in natural way at the boundaries between the adjacent regions because the linearities of the respective regions Ra–Rd differ. However, because the present embodiment includes the common horizontal and vertical deflection driving circuits 32H, 32V for the plurality of the deflection devices 11, the linearity of each region can be adjusted while maintaining continuity of images at the boundaries between the adjacent regions. The adjustment is performed by the correcting element connected to the deflection driving circuits 32H, 32V and deflection devices. Thus, it is possible to obtain a color cathode-ray tube capable of displaying optimum images easily. As a result, it is possible to provide a cathode-ray tube apparatus wherein an adjustment for making images displayed independently on the respective regions to continue with one another without any sense of incongruity at the boundaries between the adjacent regions can be easily performed, thus capable of displaying a synthesized image superior in quality.

Figure 8:
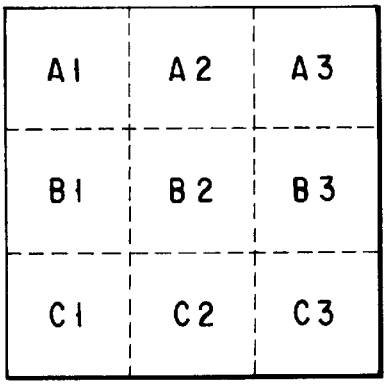
FIG. 8 is a diagram showing schematically a connection of the deflection devices and the deflection driving circuits in the cathode-ray tube apparatus according to another embodiment of the present invention.

FIG. 8 shows a cathode-ray tube apparatus having a total of nine divided regions arranged in the form of a matrix, three (rows)× three (columns), as a comparative example. When nine deflection devices of such a cathode-ray tube are driven by nine independent deflection driving circuits, a deflection device for a peripheral region of the display screen such as A1 is adjusted by considering relations with the adjacent divided regions such as A2 and B1. A deflection device for a center region of the display screen such as B2 is adjusted by considering relations with the peripheral regions such as A2, B1, C2 and B3. Specifically, the center region of the display screen has more adjacent regions which must be considered upon adjustment than peripheral regions. Thus, the center region is less free and less easy to adjust than the peripheral regions. As described above, the divided regions are adjusted each other with respect to many items including the amplitude, linearity, distortion of image, graphic pattern and the like. Thus, the adjustment is very difficult.

With the cathode-ray tube apparatus according to the present invention, since the plurality of deflection devices 11 are driven by the common deflection driving circuit 30, most of adjustments for a characteristic difference of the deflection driving circuits can be omitted, thereby largely simplifying the adjustments of the deflection devices. The aforementioned effect can be recognized more clearly if such a construction of the present embodiment is applied to a cathode-ray tube apparatus in which the display screen has nine or more divided regions and contains at least one region which is difficult to adjust because of being surrounded by another regions.

Further, a relation between the deflection devices, the deflection driving circuit and their production cost will be described. In the conventional apparatus, the deflection driving circuits are equal to the number of the regions of the phosphor screen that are scanned. Production cost of the deflection driving circuits increases in proportion with the number of the divided regions to be scanned. In a case when a single deflection device is driven by a single deflection driving circuit, if the number of the divided regions is 10, the cost of the deflection driving circuits becomes ten time that of the unit price of the deflection driving circuit. In a cathode-ray tube apparatus which displays a large image by synthesizing divided images displayed in a plurality of divided regions, the divided regions are relatively small, and low power consumption type electron guns and deflection devices having a simple construction are used to display images in the respective regions. In an apparatus in which a single deflection device is driven by a single deflection driving circuit, if 10 or more deflection driving circuits are utilized in that apparatus, as described above, the total cost thereof is expanded even though cheap driving circuits can be used.

Figure 9:
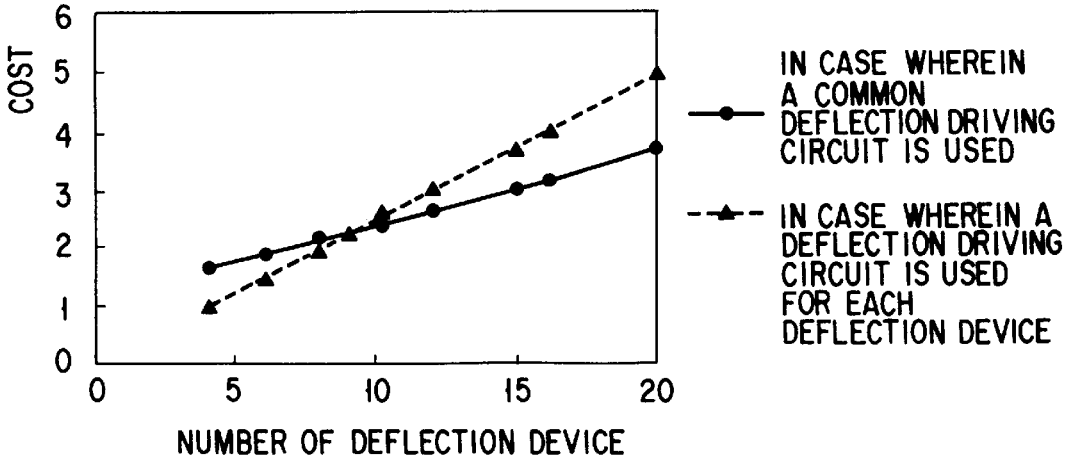
FIG. 9 is a graph showing the relationship between the manufacturing cost and the number of the deflection devices.

According to another embodiment of the present imvention, the cathode-ray take includes a plurality of the deflection devices that are driven by the common deflection driving. The number of the common deflection driving circuits does not change even if the number of the deflection devices to be driven increases (synchronizing circuit, initial stage circuit, (correcting element, power circuit, final stage circuit, etc.). The inventors of the present invention examined a relation between the deflection driving circuit and the number of the deflection devices in detail. As a result, as shown in FIG. 9, it was found that reduction of the production cost of the cathode-ray tube apparatus could be achieved more securely as the number of the deflection devices increases or as the number of the divided regions on the phosphor screen increases. According to FIG. 9, if the number of regions to be scanned is 9 or more, that is, 9 or more deflection devices are driven by a common deflection driving circuit, the production cost could be suppressed to be lower than the conventional cathode-ray tube apparatus.

The screen size, depth of the apparatus, weight thereof and the like must be taken into account to realize the cathode-ray tube apparatus according to the present embodiment on a practical use level. For example, if the screen size of the cathode-ray tube apparatus is 20 inch, the weight allowing its practical use is less than about 10 kg. To realize this weight, the thickness of the face plate of the vacuum envelope must be 5 mm or below. By equation disclosed in U.S. Pat. No. 5,287,034, the size of a single divided region is desired to be about 6 inch to support a load of the atmospheric pressure acting on the vacuum envelope, according to a relation between the thickness t of the face plate and an interval between the divided regions P. In this case, the number of the divided regions is 12 or more. Thus, it is desirable that the number of the divided regions on the phosphor screen is 12 or more considering the strength of the vacuum envelope, in order to provide a cathode-ray tube apparatus having a screen size appropriate for practical use.

In the cathode-ray tube apparatus according to the present embodiment, as described above, various operations and effects can be obtained depending on the number of deflection devices which are driven by the common deflection driving circuit. Specifically, if two or more deflection devices are constructed to be driven by the common deflection driving circuit, the efficiency of the adjustment work can be improved. Particularly, the effect become remarkable if nine or more deflection devices are constructed to be driven by the common deflection driving circuit. Further, if the number of the deflection devices driven by the common deflection driving circuit is nine or more, the production cost can be reduced. If the number thereof is 12 or more, the strength of the vacuum envelope can be intensified.

Figure 10:
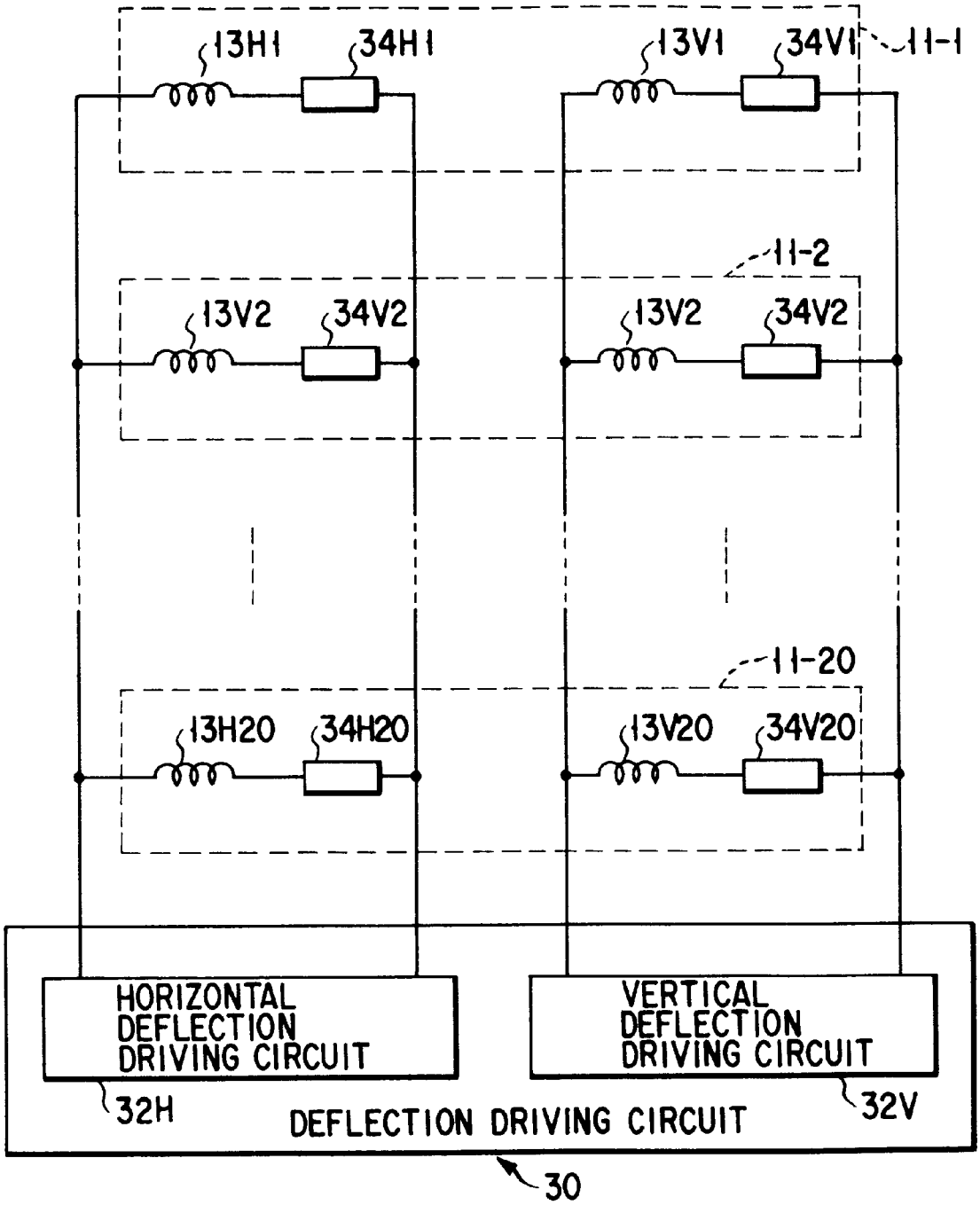
FIG. 10 is a diagram showing schematically a connection of the deflection devices and deflection driving circuits, according to another embodiment of the present invention.

Next a color cathode-ray tube according to another embodiment of the present invention will be described. Referring to FIG. 10, according to another embodiment, the horizontal deflection coils 13H1–13H20 of 20 deflection devices 11-1 to 11-20 (only 11-1, 11-2 and 11-20 are indicated here) are connected to the horizontal deflection driving circuit 32H in the deflection driving circuit 30 in parallel. 20 vertical deflection coils 13V1–13V20 are connected to the vertical deflection driving circuit 32V in parallel.

Further, the horizontal deflection correcting elements 34H1–34H20 are connected to the respective horizontal deflection coils 13H1–13H20 in series, and the vertical deflection correcting elements 34V1–34V20 are connected to the respective vertical deflection coils 13V1–13V20 in series.

As in the previously described embodiment, the horizontal deflection correcting elements 34H1–34H20 are each made of the variable inductance element and the vertical deflection correcting elements 34V1–34V20 are each made of the variable resistance element. The capacities of the variable inductance element and variable resistance element are determined depending on the impedance of the horizontal and vertical deflection coils, respectively.

The other construction is the same as in the above-described embodiments. The same reference numerals represent the same components and the detailed description thereof will be omitted.

With this embodiment, a difference in performance among the deflection devices 11-1 to 11-20 can be adjusted by means of the horizontal and vertical deflection correcting elements 34H1–34H20, 34V1–34V20 connected to the horizontal and vertical deflection coils 13H1–13H20, 13V1–13V20 respectively of the deflection devices. Because the horizontal deflection coils 13H1–13H20 of the deflection devices 11-1 to 11-20 are connected to the common horizontal deflection driving circuit 32H and the vertical deflection coils 13V1–13V20 are connected to the common vertical deflection driving circuit 32V, the linearities of images in the adjacent regions can be adjusted easily, so that such a color cathode-ray tube capable of displaying an optimum picture easily can be provided.

The present invention is not restricted to the above-described embodiments but can be modified in various forms within the scope of the present invention. For example, although, in the above respective embodiments, all the correcting elements are connected in parallel or in series with respect to the horizontal and vertical deflection coils in the plurality of the deflection devices, the connection of the correcting elements may be carried out by combining the parallel connection and series connection appropriately if the scanning ranges of the respective deflection devices can be corrected independently.

Although in the above respective embodiments, the variable inductance element and the variable resistance element are utilized as the horizontal deflection correcting element and the vertical deflection correct ing element respectively, the other correcting elements may be utilized instead of the above elements if they can modify the scanning ranges of the respective deflection devices.

Further, although in the above respective embodiments, the correcting elements are connected to all the horizontal and vertical deflecting coils, it is permissible to connect the correcting elements selectively to only particular horizontal and vertical deflection coils.

If the deflection devices are produced at a high precision such that a difference in performance among the plural deflection devices does not affect the quality of the synthesized image, a color cathode-ray tube apparatus having the same effect can be provided by only connecting the horizontal and vertical deflection coils of the respective deflection devices to the common horizontal and vertical deflection driving circuits respectively, without use of the correcting elements.

Figure 11:
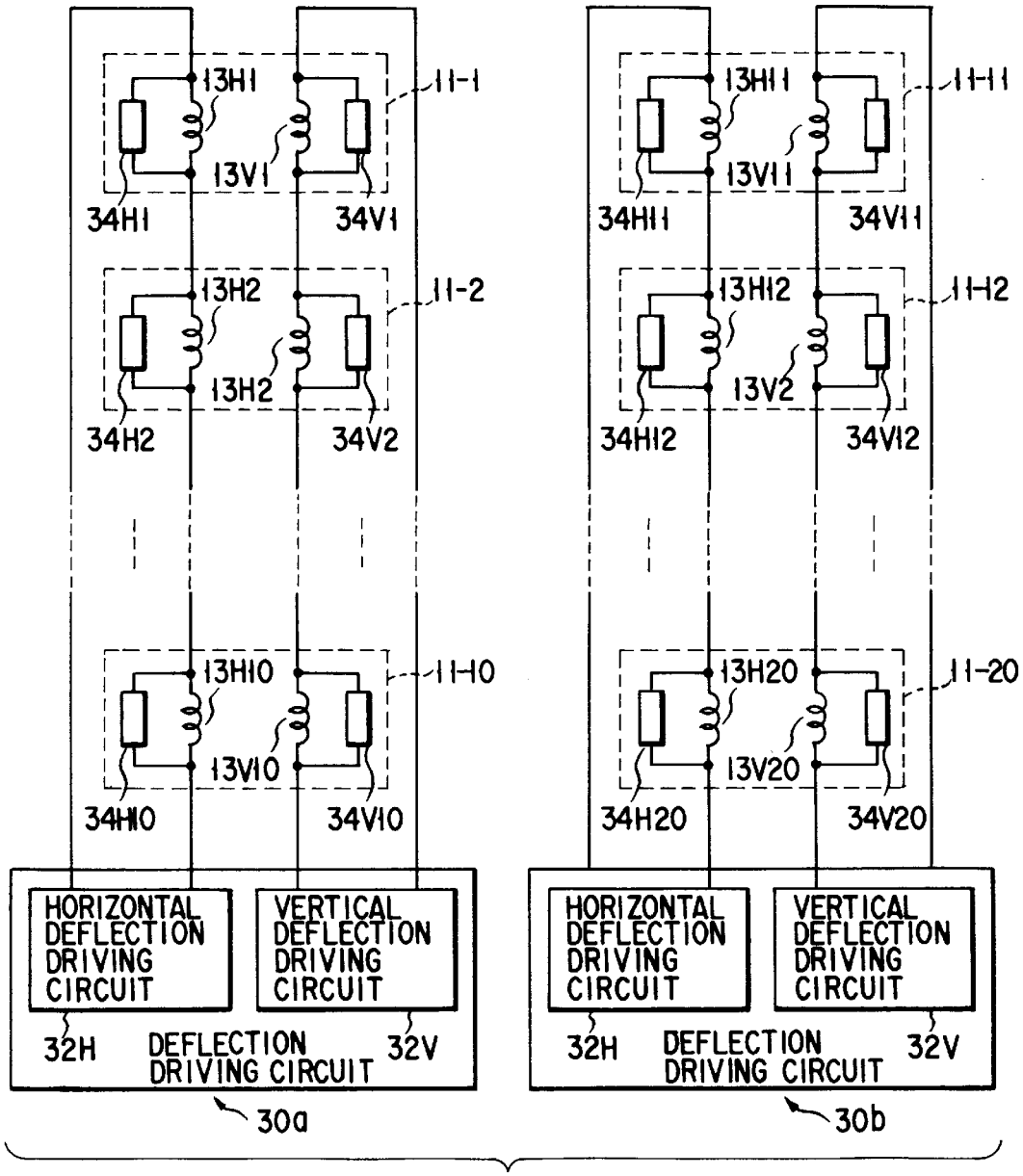
FIG. 11 is a diagram showing schematically a connection of the deflection devices and deflection driving circuits, according to still another embodiment of the present invention.

Although, in the above respective embodiments, all the deflection devices are connected to the single common deflection driving circuit, it is permissible to provide a plurality of independent deflection driving circuits, depending on the characteristic of the deflection devices or scale of the circuit, such that plural groups of the deflection devices are driven independently by the respective deflection driving circuits. For example, according to an embodiment shown in FIG. 11, 10 deflection devices 11-1 to 11-10 corresponding to the divided regions R1 to R10 is driven by a first common deflection driving circuit 30*a*, and 10 deflection devices 11-11 to 11-20 corresponding to the divided regions R11 to R20 are driven by a second common deflection driving circuit 30*b*. In this embodiment, the same reference numerals as in the above mentioned embodiments represents the same component, thus the detailed description thereof will be omitted.

Further, it is permissible to divide the plurality of the deflection devices to plural groups including arbitrarily plural deflection devices such that the respective groups of the deflection devices are driven by independent deflection driving circuits.

In the above mentioned embodiments, although the deflection devices and the deflection driving circuit has been described, for example, correction coils for correcting an interference generated due to the deflection and the like may be driven by a common deflection circuit together with the deflection devices.

Meantime, the present invention is not restricted to the color-picture tube but may be applied to the other cathode-ray tubes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A cathode-ray tube apparatus comprising:

a vacuum envelope having a substantially rectangular flat face plate and a substantially rectangular flat rear plate opposing to the face plate substantially in parallel thereto;

a phosphor screen formed on an inner surface of the face plate;

a plurality of electron guns disposed on the rear plate, for emitting electron beams to the phosphor screen; and deflecting means for deflecting the plurality of electron beams emitted from the electron guns so as to dividedly scan a plurality of regions of the phosphor screen by the electron beams, the deflecting means including:

a plurality of deflection devices disposed corresponding to the respective electron guns and each having horizontal and vertical deflection coils for deflecting the electron beam emitted from the corresponding electron gun; and a common deflection driving circuit for driving at least two of the deflection devices; and a correcting element connected to the respective deflection devices which are driven by the common deflection driving circuit, for correcting the amplitude of deflection current flowing in the horizontal and vertical deflection coils of the deflection devices to a predetermined value.

2. A cathode-ray tube apparatus according to claim 1, wherein the common deflection driving circuit is used for driving all of the plurality of the deflection devices.

3. A cathode-ray tube apparatus according to claim 1, wherein the common deflection driving circuit is used for driving at least nine of the deflection devices.

4. A cathode-ray tube apparatus according to claim 1, wherein the common deflection driving circuit is used for driving at least twelve of the deflection devices.

5. A cathode-ray tube apparatus comprising:

a vacuum envelope having a substantially rectangular flat face plate and a substantially rectangular flat rear plate opposing to the face plate substantially in parallel thereto;

a phosphor screen formed on an inner surface of the face plate;

a plurality of electron guns disposed on the rear plate, for emitting electron beams to the phosphor screen; and deflecting means for deflecting the plurality of electron beams emitted from the electron guns so as to dividedly scan a plurality of regions of the phosphor screen by the electron beams, the deflecting means including:

a plurality of deflecting devices disposed corresponding to the respective electron guns and each having horizontal and vertical deflection coils for deflecting the electron beam emitted from the corresponding electron gun; and a common deflection driving circuit for driving at least two of the deflection devices;

the horizontal deflection coils of the deflection devices driven by the common deflection driving circuit being connected to each other in series, and the vertical deflection coils of the deflection devices driven by the common deflection driving circuit being connected to each other in series, the common deflection driving circuit comprising a horizontal deflection driving circuit for supplying horizontal deflection current to the horizontal deflection coils connected in series, and a vertical deflection driving circuit for supplying vertical deflection current to the vertical deflection coils connected in series.

6. A cathode-ray tube apparatus according to claim 5, wherein the deflecting means includes a horizontal correcting element which is connected in parallel to at least one of the horizontal deflection coils connected in series so as to correct the amplitude of horizontal deflection current flowing in the horizontal deflection coil; and a vertical correcting element which is connected in parallel to at least one of the vertical deflection coils connected in series so as to correct the amplitude of vertical deflection current flowing in the vertical deflection coil.

7. A cathode-ray tube apparatus according to claim 5, wherein the deflecting means includes a plurality of horizontal correcting elements which are connected in parallel to the respective horizontal deflection coils connected in series so as to correct the amplitude of horizontal deflection current flowing in the horizontal deflection coils; and a plurality of vertical correcting elements which are connected in parallel to the respective vertical deflection coils connected in series so as to correct the amplitude of vertical deflection current flowing in the vertical deflection coils.

8. A cathode-ray tube apparatus comprising:

a vacuum envelope having a substantially rectangular flat face plate and a substantially rectangular flat rear plate opposing to the face plate substantially in parallel thereto;

a phosphor screen formed on an inner surface of the face plate;

a plurality of electron guns disposed on the rear plate, for emitting electron beams to the phosphor screen; and deflecting means for deflecting the plurality of electron beams emitted from the electron guns so as to dividedly scan a plurality of regions of the phosphor screen by the electron beams, the deflecting means including:

a plurality of deflection devices disposed corresponding to the respective electron guns and each having horizontal and vertical deflection coils for deflecting the electron beam emitted from the corresponding electron gun; and a common deflection driving circuit for driving at least two of the deflection devices;

the horizontal deflection coils of the deflection devices driven by the common deflection driving circuit being connected to each other in parallel, and the vertical deflection coils of the deflection devices driven by the common deflection driving circuit being connected to each other in parallel, the common deflection driving circuit comprising a horizontal deflection driving circuit for supplying horizontal deflection current to the horizontal deflection coils connected in parallel, and a vertical deflection driving circuit for supplying vertical deflection current to the vertical deflection coils connected in parallel;

the deflecting means including a horizontal correcting element which is connected in series to at least one of the horizontal deflection coils connected in parallel so as to correct the amplitude of horizontal deflection current flowing in the horizontal deflection coil, and a vertical correcting element which is connected in series to at least one of the vertical deflection coil connected in parallel so as to correct the amplitude of vertical deflection current flowing in the vertical deflection coil.

9. A cathode-ray tube apparatus comprising:

a vacuum envelope having a substantially rectangular flat face plate and a substantially rectangular flat rear plate opposing to the face plate substantially in parallel thereto;

a phosphor screen formed on an inner surface of the face plate;

a plurality of electron guns disposed on the rear plate, for emitting electron beams to the phosphor screen; and deflecting means for deflecting the plurality of electron beams emitted from the electron guns so as to dividedly scan a plurality of regions of the phosphor screen by the electron beams;

the deflecting means including:

a plurality of deflection devices disposed corresponding to the respective electron guns and each having horizontal and vertical deflection coils for deflecting the electron beam emitted from the corresponding electron gun; and a common deflection driving circuit for driving at least two of the deflection devices;

the horizontal deflection coils of the deflection devices driven by the common deflection driving circuit being connected to each other in parallel, and the vertical deflection coils of the deflection devices driven by the common deflection driving circuit being connected to each other in parallel;

the common deflection driving circuit for supplying horizontal deflection current to the horizontal deflection coils connected in parallel, and a vertical deflection driving circuit for supplying vertical deflection current to the vertical deflection coils connected in parallel;

the deflecting means including horizontal correcting elements which are connected in series to the respective horizontal deflection coils connected in parallel so as to correct the amplitude of horizontal deflection current flowing in the horizontal deflection coils; and vertical correcting elements which are connected in series to the respective vertical deflection coils connected in parallel so as to correct the amplitude of vertical deflection current flowing in the vertical deflection coils.

* * * * *